US009737190B2

(12) United States Patent
Mersch

(10) Patent No.: US 9,737,190 B2
(45) Date of Patent: Aug. 22, 2017

(54) DISHWASHER APPLIANCE AND A METHOD FOR OPERATING A DISHWASHER APPLIANCE

(71) Applicant: General Electric Company, Schenectady, NY (US)

(72) Inventor: Matthew David Mersch, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 588 days.

(21) Appl. No.: 14/283,831

(22) Filed: May 21, 2014

(65) Prior Publication Data

US 2015/0335223 A1 Nov. 26, 2015

(51) Int. Cl.

| | |
|---|---|
| ***A47L 15/22*** | (2006.01) |
| ***A47L 15/42*** | (2006.01) |
| ***A47L 15/16*** | (2006.01) |
| *A47L 15/50* | (2006.01) |

(52) U.S. Cl.

CPC ..... *A47L 15/22* (2013.01); *A47L 15/16* (2013.01); *A47L 15/4221* (2013.01); *A47L 15/4278* (2013.01); *A47L 15/508* (2013.01); *A47L 15/505* (2013.01); *A47L 2501/05* (2013.01)

(58) Field of Classification Search

CPC ..... A47L 15/22; A47L 15/4221; A47L 15/16; A47L 2501/05; A47L 15/505; A47L 15/508; A47L 15/4278

See application file for complete search history.

(56) References Cited

U.S. PATENT DOCUMENTS

| | | | | |
|---|---|---|---|---|
| 6,705,330 | B1 * | 3/2004 | Favret | A47L 15/4221 134/174 |
| 7,475,696 | B2 | 1/2009 | Vanderroest | |
| 7,914,625 | B2 | 3/2011 | Bertsch et al. | |
| 7,918,942 | B2 | 4/2011 | Nagel et al. | |
| 7,969,772 | B2 | 6/2011 | Gubbins et al. | |
| 8,161,995 | B2 | 4/2012 | Armstrong et al. | |
| 2003/0159720 | A1 * | 8/2003 | Favret | A47L 15/4221 134/57 D |
| 2005/0133070 | A1 * | 6/2005 | Vanderroest | A47L 15/16 134/56 D |
| 2012/0285490 | A1 * | 11/2012 | Blanchard | A47L 15/4219 134/25.2 |
| 2015/0250374 | A1 * | 9/2015 | McDaniel | A47L 15/508 134/170 |

* cited by examiner

*Primary Examiner* — Alexander Markoff

(74) *Attorney, Agent, or Firm* — Dority & Manning, P.A.

(57) ABSTRACT

A dishwasher appliance is provided. The dishwasher appliance includes a first spray assembly and a second spray assembly. A pressure actuated valve is coupled to a supply conduit. The pressure actuated valve selectively permits wash fluid from the supply conduit to flow to the second spray assembly. A related method for operating a dishwasher appliance is also provided.

16 Claims, 7 Drawing Sheets

DISHWASHER APPLIANCE AND A METHOD FOR OPERATING A DISHWASHER APPLIANCE

FIELD OF THE INVENTION

The present subject matter relates generally to dishwasher appliances.

BACKGROUND OF THE INVENTION

Dishwasher appliances generally include a tub that defines a wash chamber therein. Various spray assemblies may be disposed within the wash chamber. During operation of the dishwasher appliances, the spray assemblies direct wash fluid towards articles within rack assemblies in the wash chamber. Thus, the spray assemblies provide multiple outlets for directing wash fluid onto articles within the rack assemblies during operation of the dishwasher appliances.

In certain dishwasher appliances, wash fluid is directed to separate spray assemblies at a fixed ratio. Thus, a first one of the spray assemblies may receive about seventy percent of a flow of wash fluid from a supply conduit while a second one of the spray assemblies may receive about thirty percent of the flow of wash fluid from the supply conduit. The fixed ratio of wash fluid flow can provide a convenient distribution of wash fluid when both the first and second spray assemblies are needed but can be inefficient when either the first spray assembly or the second spray assembly is not needed.

Accordingly, a dishwasher appliance with features for regulating fluid flow to various spray assemblies of the dishwasher appliance would be useful. In particular, a dishwasher appliance with features for selectively directing wash fluid to a secondary spray assembly of the dishwasher appliance would be useful.

BRIEF DESCRIPTION OF THE INVENTION

The present subject matter provides a dishwasher appliance. The dishwasher appliance includes a first spray assembly and a second spray assembly. A pressure actuated valve is coupled to a supply conduit. The pressure actuated valve selectively permits wash fluid from the supply conduit to flow to the second spray assembly. A related method for operating a dishwasher appliance is also provided. Additional aspects and advantages of the invention will be set forth in part in the following description, or may be apparent from the description, or may be learned through practice of the invention.

In a first exemplary embodiment, a dishwasher appliance is provided. The dishwasher appliance includes a tub that defines a wash chamber. A rack assembly is disposed within the wash chamber of the tub. A first spray assembly is positioned adjacent the rack assembly such that the first spray assembly is positioned for directing a first flow of wash fluid towards the rack assembly. A second spray assembly is positioned adjacent the rack assembly such that the second spray assembly is positioned for directing a second flow of wash fluid towards the rack assembly. The dishwasher appliance also includes a supply conduit and a pressure actuated valve coupled to the supply conduit such that the pressure actuated valve selectively permits wash fluid from the supply conduit to flow to the second spray assembly.

In a second exemplary embodiment, a dishwasher appliance is provided. The dishwasher appliance defines a vertical direction. The dishwasher appliance includes a tub that defines a wash chamber. The wash chamber extends between a top portion and a bottom portion along the vertical direction. A lower rack assembly is disposed within the wash chamber of the tub and is positioned adjacent the bottom portion of the wash chamber. An upper rack assembly is disposed within the wash chamber of the tub and is positioned above the lower rack assembly along the vertical direction. A first spray assembly positioned adjacent the lower rack assembly such that the first spray assembly is positioned for directing a first flow of wash fluid towards the lower rack assembly. A second spray assembly is positioned adjacent the upper rack assembly such that the second spray assembly is positioned for directing a second flow of wash fluid towards the upper rack assembly. The dishwasher appliance also includes a variable speed pump. A supply conduit extends from the variable speed pump to the first and second spray assemblies. The supply conduit is configured for directing wash fluid from the variable speed pump to the first and second spray assemblies. A pressure actuated valve is coupled to the supply conduit such that the pressure actuated valve selectively permits wash fluid from the supply conduit to flow to the second spray assembly.

In a third exemplary embodiment, a method for operating a dishwasher appliance is provided. The method includes operating a variable speed pump of the dishwasher appliance in a first operating mode. A pressure actuated valve of the dishwasher appliance is in a closed configuration during the step of operating. The method also includes spraying wash fluid from a first spray assembly of the dishwasher appliance towards articles within a wash chamber of the dishwasher appliance during the step of operating. A second spray assembly of the dishwasher appliance does not spraying wash fluid towards the articles within the wash chamber during the step of spraying. The method further includes working the variable speed pump of the dishwasher appliance in a second operating mode. The pressure actuated valve of the dishwasher appliance is in an open configuration during the step of working. The method also includes directing wash fluid from the first and second spray assemblies of the dishwasher appliance towards articles within the wash chamber of the dishwasher appliance during the step of working.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
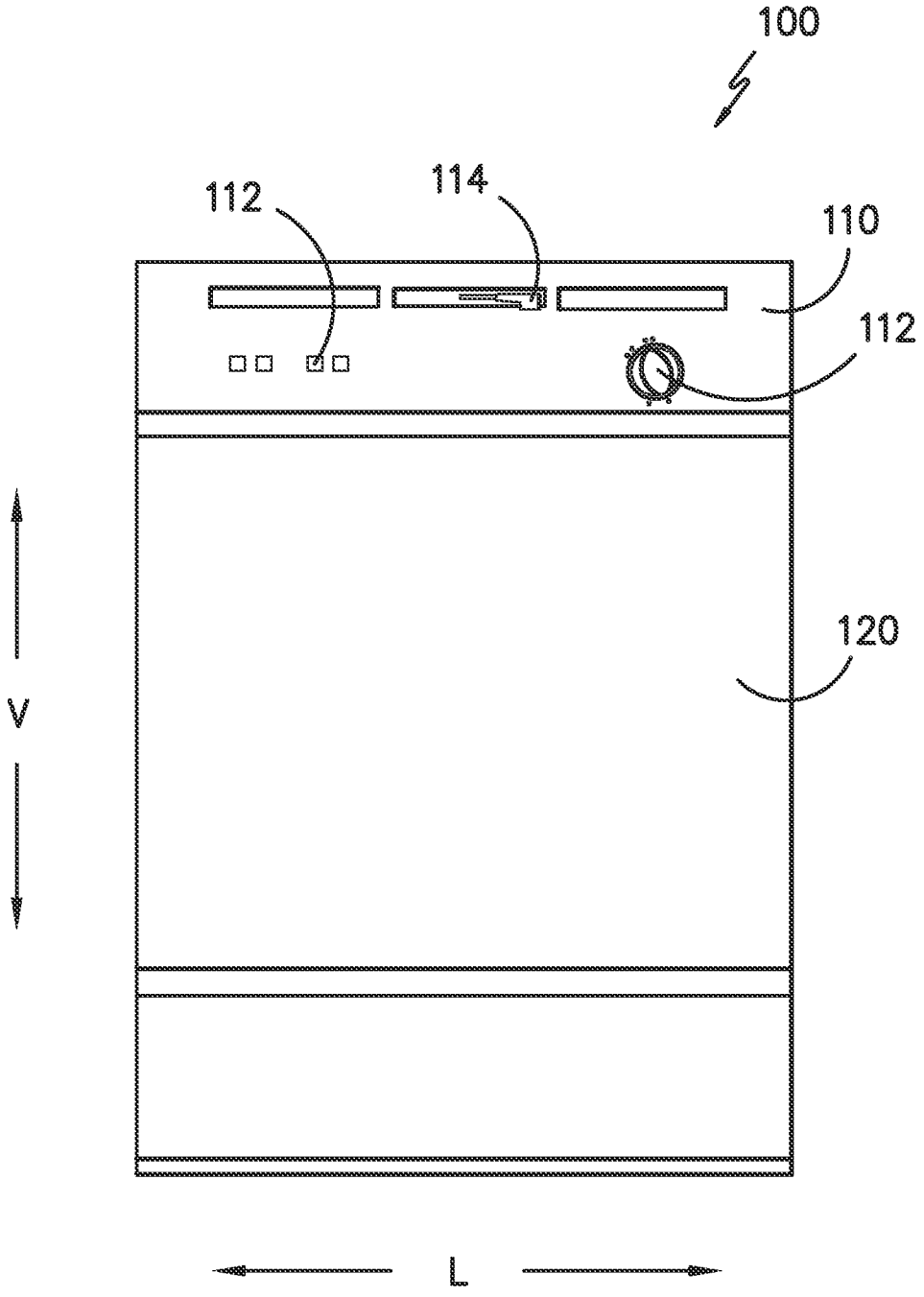
FIG. 1 provides a front elevation view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
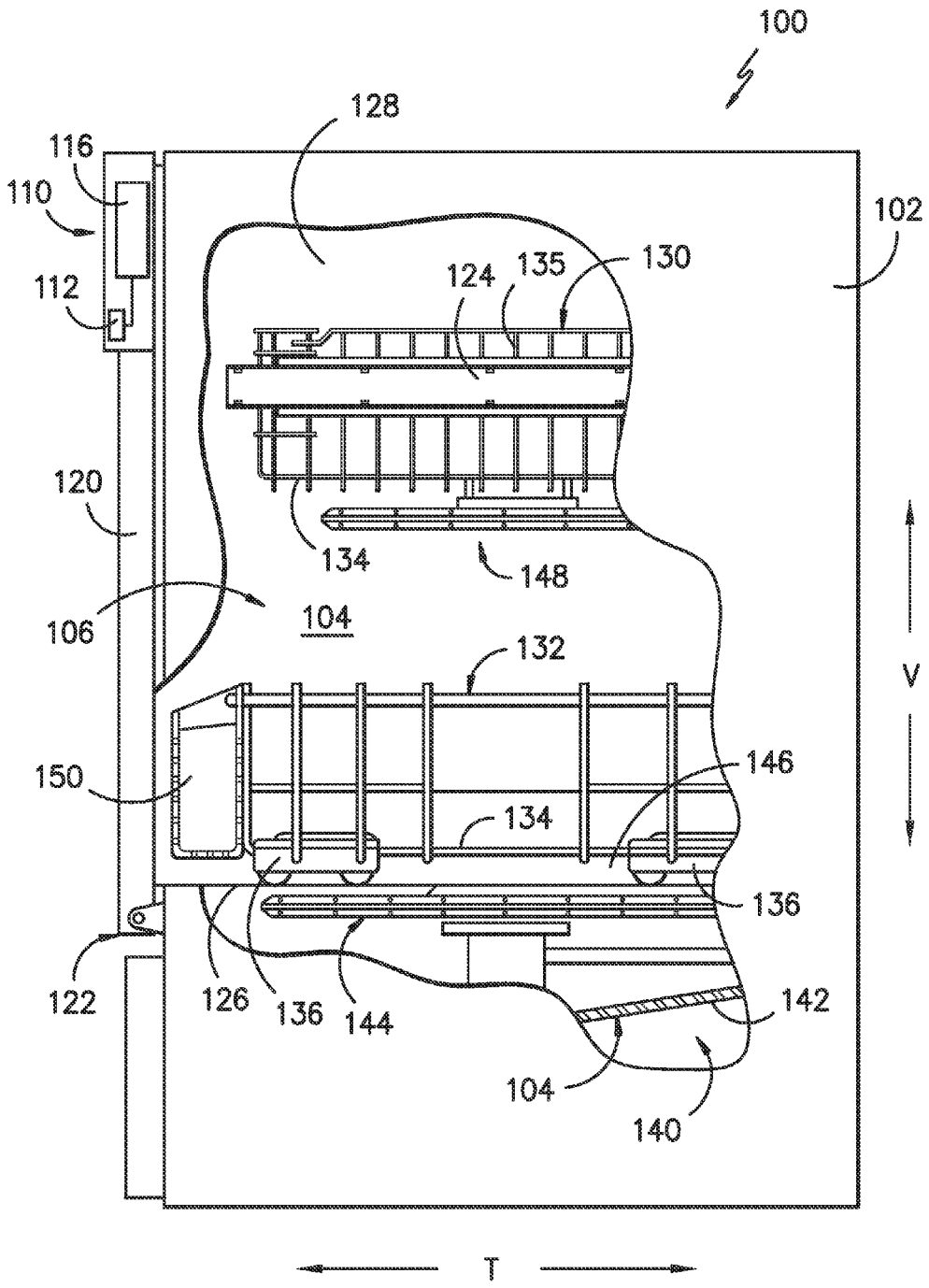
FIG. 2 provides a partial side section view of the exemplary dishwasher appliance of FIG. 1.

FIGS. 1 and 2 depict a dishwasher appliance 100 according to an exemplary embodiment of the present subject matter. Dishwasher appliance 100 defines a vertical direction V, a lateral direction L (FIG. 1) and a transverse direction T (FIG. 2). The vertical, lateral, and transverse directions V, L, and T are mutually perpendicular and form an orthogonal direction system.

Dishwasher appliance 100 includes a chassis or cabinet 102 having a tub 104. Tub 104 defines a wash chamber 106 and includes a front opening (not shown) and a door 120 hinged at its bottom 122 for movement between a normally closed vertical position (shown in FIGS. 1 and 2), wherein wash chamber 106 is sealed shut for washing operation, and a horizontal open position for loading and unloading of articles from dishwasher appliance 100. A latch 114 is used to lock and unlock door 120 for access to chamber 106.

Slide assemblies 124 are mounted on opposing tub sidewalls 128 to support and provide for movement of an upper rack assembly 130. Lower guides 126 are positioned in opposing manner of the sides of chamber 106 and provide a ridge or shelf for roller assemblies 136 so as to support and provide for movement of a lower rack assembly 132. Each of the upper and lower rack assemblies 130 and 132 is fabricated into lattice structures including a plurality of elongated members 134 and 135 that extend in lateral (L), transverse (T), and/or vertical (V) directions. Each rack assembly 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by slide assemblies 124 and roller assemblies 136 that carry the upper and lower rack assemblies 130 and 132, respectively. A silverware basket 150 may be removably attached to the lower rack assembly 132 for placement of silverware, small utensils, and the like, that are too small to be accommodated by the upper and lower rack assemblies 130, 132.

Dishwasher appliance 100 also includes a lower spray assembly 144 that is rotatably mounted within a lower region 146 of the wash chamber 106 and above a tub sump portion 142 so as to rotate in relatively close proximity to lower rack assembly 132. A spray arm or mid-level spray assembly 148 is located in an upper region of the wash chamber 106 and may be located in close proximity to upper rack assembly 130. Additionally, an upper spray assembly (not shown) may be located above the upper rack assembly 130 and mounted to an upper wall of tub 104.

Lower and mid-level spray assemblies 144, 148 and the upper spray assembly are fed by a fluid circulation assembly for circulating water and wash fluid in the tub 104. Portions of the fluid circulation assembly may be located in a machinery compartment 140 located below tub sump portion 142 of tub 104, as generally recognized in the art. Each spray assembly includes an arrangement of discharge ports or orifices for directing washing liquid onto dishes or other articles located in upper and lower rack assemblies 130, 132, respectively. The arrangement of the discharge ports in at least the lower spray assembly 144 provides a rotational force by virtue of washing fluid flowing through the discharge ports. The resultant rotation of lower spray assembly 144 provides coverage of dishes and other articles with a washing spray.

Dishwasher appliance 100 is further equipped with a controller 116 to regulate operation of dishwasher appliance 100. Controller 116 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 116 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 116 may be positioned in a variety of locations throughout dishwasher appliance 100. In the illustrated embodiment, controller 116 may be located within a control panel area 110 of door 120 as shown. In such an embodiment, input/output ("I/O") signals may be routed between the control system and various operational components of dishwasher appliance 100 along wiring harnesses that may be routed through bottom 122 of door 120. Typically, the controller 116 includes a user interface panel 112 through which a user may select various operational features and modes and monitor progress of the dishwasher appliance 100. In one embodiment, user interface panel 112 may represent a general purpose I/O ("GPIO") device or functional block. In one embodiment, the user interface panel 112 may include input components, such as one or more of a variety of electrical, mechanical or electro-mechanical input devices including rotary dials, push buttons, and touch pads. User interface panel 112 may include a display component, such as a digital or analog display device designed to provide operational feedback to a user. User interface panel 112 may be in communication with controller 116 via one or more signal lines or shared communication busses.

It should be appreciated that the present subject matter is not limited to any particular style, model, or configuration of dishwasher appliance. Thus, the exemplary embodiment depicted in FIGS. 1 and 2 is provided for illustrative purposes only. For example, different locations may be provided for a user interface 112, different configurations may be provided for upper and lower rack assemblies 130, 132 and/or lower and mid-level spray assemblies 144, 148, and other differences may be applied as well.

Figure 3:
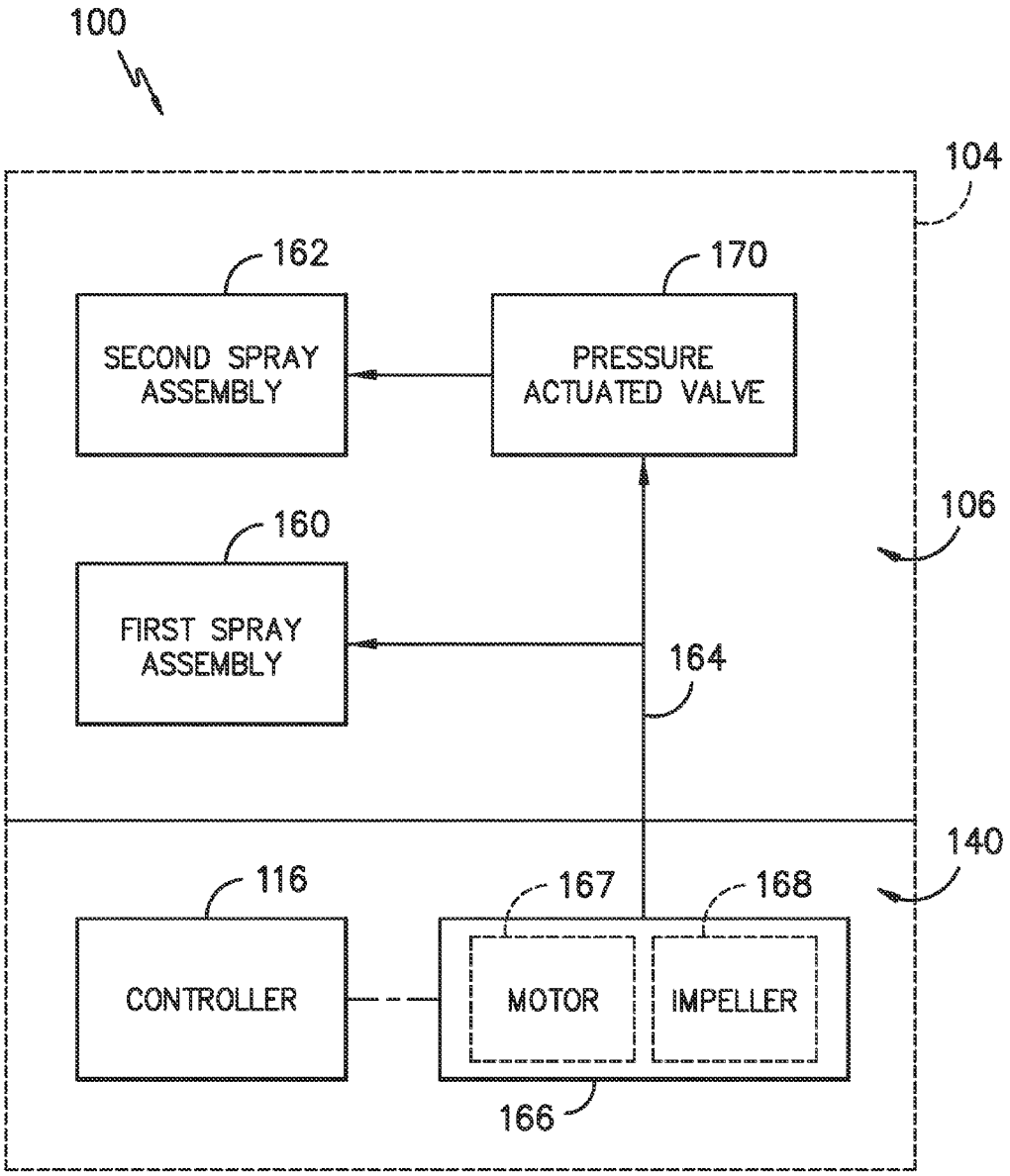
FIG. 3 provides a schematic view of certain components of the exemplary dishwasher appliance of FIG. 1.

FIG. 3 provides a schematic view of certain components of dishwasher appliance 100. As may be seen in FIG. 3, dishwasher appliance 100 includes a first spray assembly 160 and a second spray assembly 162. First and second spray assemblies 160, 162 are positioned and oriented for directing respective flows of wash fluid towards articles within wash chamber 106 of tub 104. The flows of wash fluid from first and second spray assemblies 160, 162 assist with cleaning articles within upper and lower rack assemblies 130, 132 (FIG. 2), as will be understood by those skilled in the art. Thus, dishwasher appliance 100 includes features for, e.g., selectively, directing multiple flows of washing fluid into wash chamber 106 of tub 104.

First spray assembly 160 may be positioned and/or be oriented for directing a first flow of wash fluid towards or into lower rack assembly 132. For example, first spray assembly 160 may be a spray arm, such as lower spray assembly 144 of dishwasher appliance 100. Thus, first spray assembly 160 may be a spray arm rotatably mounted to tub 104 below lower rack assembly 132. However, it should be understood that first spray assembly 160 may be any suitable spray assembly in alternative exemplary embodiments. For example, first spray assembly 160 may be a bottle washer, a bowl scrubber, etc., in alternative exemplary embodiments.

Second spray assembly 162 may be positioned and/or be oriented for directing a second flow of wash fluid towards or into upper rack assembly 130. For example, second spray assembly 162 may be mid-level spray assembly 148 or the upper spray assembly. Thus, second spray assembly 162 may be positioned above first spray assembly 160. However, it should be understood that second spray assembly 162 may be any suitable spray assembly in alternative exemplary embodiments. For example, second spray assembly 162 may be a bottle washer, a bowl scrubber, etc., in alternative exemplary embodiments.

Dishwasher appliance 100 also includes a supply conduit 164 and a variable speed pump 166. Variable speed pump 166 may be positioned within machinery compartment 140 adjacent or below tub sump portion 142. Supply conduit 164 extends from variable speed pump 166 to first and second spray assemblies 160, 162. Supply conduit 164 places first and second spray assemblies 160, 162 in fluid communication with variable speed pump 166. Thus, supply conduit 164 is configured for directing wash fluid from variable speed pump 166 to first and second spray assemblies 160, 162 during operation of variable speed pump 166. At least a portion of supply conduit 164 may be mounted to a back wall of tub 104.

A pressure actuated valve 170 is coupled, e.g., mounted, to supply conduit 164 such that pressure actuated valve 170 selectively permits wash fluid from supply conduit 164 to flow to second spray assembly 162. For example, pressure actuated valve 170 may selectively adjusted between an open configuration and a closed configuration. In particular, pressure actuated valve 170 may be biased towards the closed configuration, and pressure actuated valve 170 may adjust from the closed configuration to the open configuration when a pressure of wash fluid within supply conduit 164, e.g., at pressure actuated valve 170, exceeds a threshold pressure. When pressure actuated valve 170 is in the closed configuration, pressure actuated valve 170 blocks or prevents wash fluid in supply conduit 164 from flowing to second spray assembly 162. Thus, second spray assembly 162 is inactive or idle when pressure actuated valve 170 is in the closed configuration. Conversely, pressure actuated valve 170 permits wash fluid in supply conduit 164 to flow to second spray assembly 162 when pressure actuated valve 170 is in the open configuration. Thus, second spray assembly 162 is active or operational when pressure actuated valve 170 is in the open configuration.

Pressure actuated valve 170 may be any suitable valve that adjusts or actuates between open and closed configurations due to the pressure of fluid supplied to the valve via supply conduit 164. Pressure actuated valve 170 may also be positioned at any suitable location within dishwasher appliance 100. For example, pressure actuated valve 170 may be positioned adjacent or within tub sump portion 142 at a bottom portion of wash chamber 106.

Variable speed pump 166 includes a motor 167 and an impeller 168. Impeller 168 is coupled to motor 167, e.g., a shaft of motor 167. Thus, during operation of motor 167, impeller 168 may rotate and draw wash fluid from tub sump portion 142 to variable speed pump 166. From variable speed pump 166, wash fluid flows through supply conduit 164 to first spray assembly 160 and second spray assembly 162, as discussed in greater detail below.

Controller 116 is in operative communication with variable speed pump 166, e.g., motor 167 of variable speed pump 166. For example, controller 116 may be configured for operating motor 167 in either of a first operating mode (e.g., a first operating speed) or a second operating mode (e.g., a second operating speed). Motor 167 may rotate impeller 168 at a first average speed in the first operating mode, and motor 167 may rotate impeller 168 at a second average speed in the second operating mode. The second average speed may be greater than the first average speed. As an example, controller 116 may utilize pulse-width modulation (PWM) or pulse-duration modulation (PDM) to vary the rotation of impeller 168 between the first and second average speeds.

When motor 167 is operating in the first operating mode, the pressure of wash fluid within supply conduit 164 is insufficient to actuate pressure actuated valve 170 to the open configuration. Conversely, the pressure of wash fluid within supply conduit 164 is sufficient to actuate pressure actuated valve 170 to the open configuration when motor 167 is operating in the second operating mode. Thus, controller 116 may selectively adjust pressure actuated valve 170 between the open and closed configurations by operating motor 167 of variable speed pump 166 in either the first or second operating modes.

As discussed above, pressure actuated valve 170 selectively permits wash fluid from supply conduit 164 to flow to second spray assembly 162. Thus, controller 116 may selectively operate second spray assembly 162 by adjusting motor 167 between the first or second operating modes. In particular, wash fluid from supply conduit 164 flows to first spray assembly 160 but is blocked from flowing to second spray assembly 162 by pressure actuated valve 170 when motor 167 is operating in the first operating mode and pressure actuated valve 170 is in the closed configuration. Conversely, wash fluid from supply conduit 164 flows to both first and second spray assemblies 160, 162 when motor 167 is operating in the second operating mode and pressure actuated valve 170 is in the open configuration.

Pressure actuated valve 170 can assist with increasing an efficiency of dishwasher appliance 100 and/or improving a consumer satisfaction with dishwasher appliance 100. For example, pressure actuated valve 170 permits a user of dishwasher appliance 100 to deactivate second spray assembly 162 when second spray assembly 162 is not needed. By only directing wash fluid to second spray assembly 162 when needed, a supply of wash fluid to first spray assembly 160 can be increased when second spray assembly 162 is not required or in use.

Figure 4:
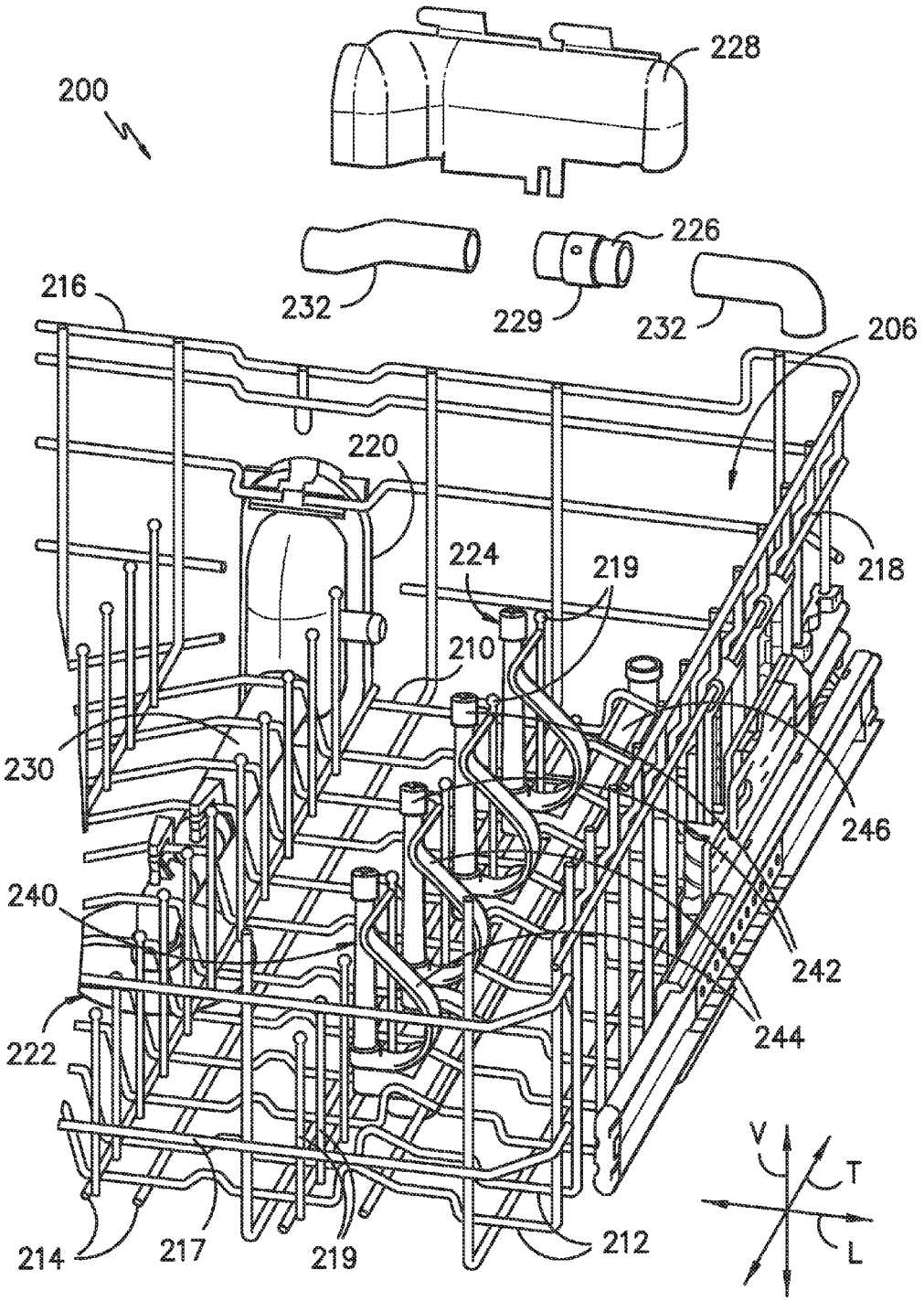
FIGS. 4 and 5 provide partial perspective views of a rack assembly according to an exemplary embodiment of the present subject matter.
Figure 5:
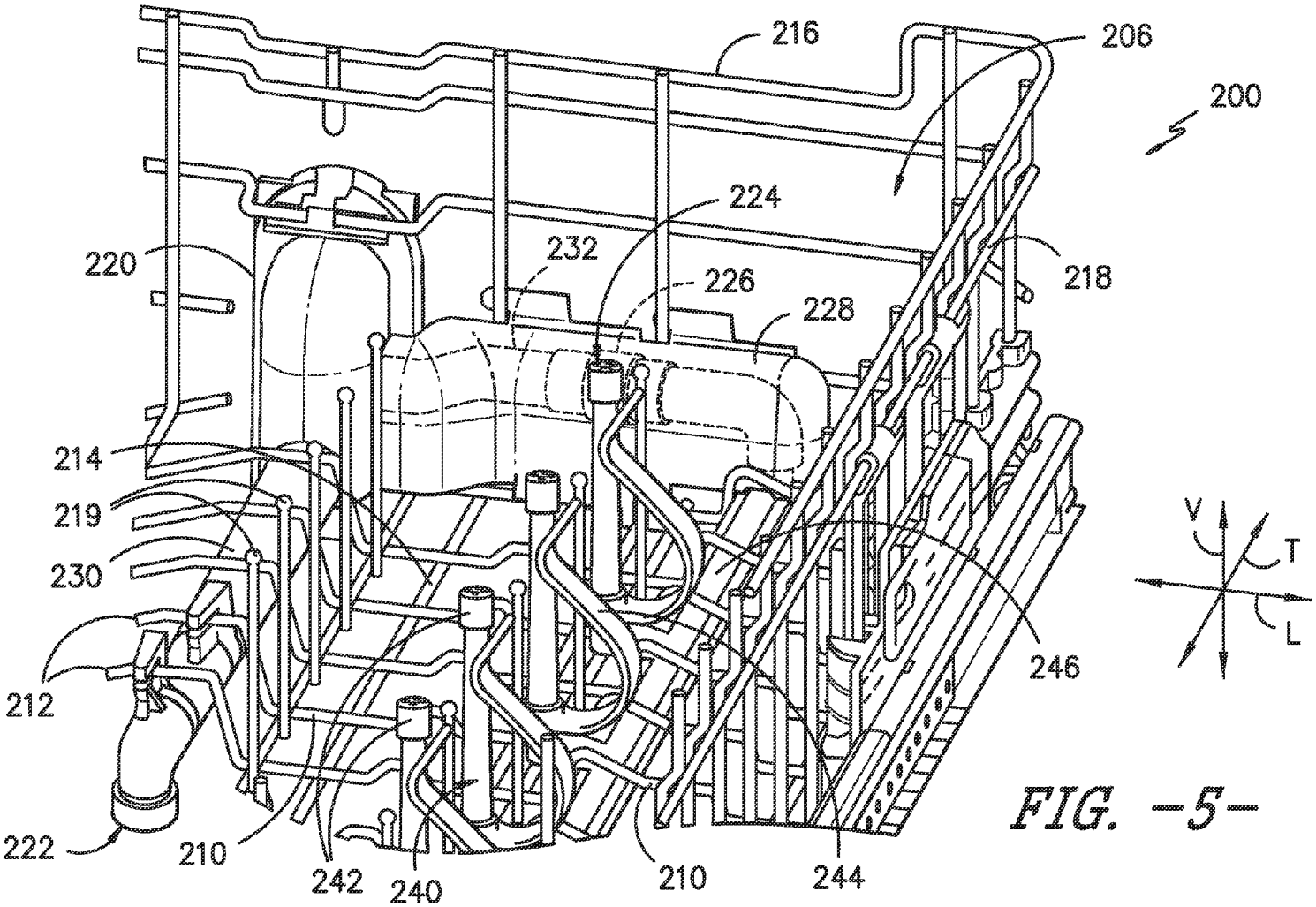

FIGS. 4 and 5 illustrate partial perspective views of a rack assembly 200 according to an exemplary embodiment of the present subject matter. Rack assembly 200 may be used in any suitable dishwasher appliance. As an example, rack assembly 200 may be utilized in dishwasher appliance 100, e.g., as upper rack assembly 130 (FIG. 2). Rack assembly 200 includes features for directing flows of wash fluid towards rack assembly 200 and for regulating the flows of wash fluid, as discussed in greater detail below.

As may be seen in FIG. 4, rack assembly 200 defines an interior volume 206. In particular, a bottom wall 210, a back wall 216, a front wall 217 and a side wall 218 of rack assembly 200 may assist with defining interior volume 206 of rack assembly 200. Thus, interior volume 206 of rack assembly 200 may be defined between bottom wall 210, back wall 216, front wall 217 and side wall 218 of rack assembly 200. Articles for washing, such as cups, bowls, bottles, etc., may be placed or positioned within interior volume 206 of rack assembly 200 such that the articles for washing are supported by rack assembly 200 during operation of dishwasher appliance 100.

Rack assembly 200 also includes a plurality of fixed tines 219 for assisting with supporting articles within interior volume 206 of rack assembly 200. Fixed tines 219 are mounted to bottom wall 210 of rack assembly 200 and extend into interior volume 206 of rack assembly 200, e.g., upwardly along the vertical direction V. In particular, as shown in FIG. 4, bottom wall 210 may include a series of lateral members 212 fixed to a series of transverse members 214. Each lateral member of lateral members 212 extends along the lateral direction L. Lateral members 212 are also spaced apart from one another along the transverse direction T. Similarly, each transverse member of transverse members 214 extend along the transverse direction T. Transverse members 214 are also spaced apart from one another along the lateral direction L. Thus, lateral members 212 and transverse members 214 form a lattice structure for containing articles within rack assembly 200. Fixed tines 219 may be mounted or fixed (e.g., welded) to lateral members 212 and/or transverse members 214 of bottom wall 210 of rack assembly 200 and extend into interior volume 206 of rack assembly 200, e.g., upwardly along the vertical direction V, from bottom wall 210.

Rack assembly 200 further includes a first spray assembly 222 and a second spray assembly 224. First and second spray assemblies 222, 224 are positioned and oriented for directing respective flows of wash fluid towards interior volume 206 of rack assembly 200. The flows of wash fluid from first and second spray assemblies 222, 224 assist with cleaning articles within interior volume 206 of rack assembly 200, as will be understood by those skilled in the art. Thus, rack assembly 200 includes features for, e.g., selectively, directing multiple flows of washing fluid into interior volume 206 of rack assembly 200.

First spray assembly 222 is positioned and/or oriented for directing a first flow of wash fluid towards or into rack assembly 200. In the exemplary embodiment shown in FIGS. 4 and 5, first spray assembly 222 may be a spray arm, such as mid-level spray assembly 148 of dishwasher appliance 100. Thus, first spray assembly 222 may be a spray arm rotatably mounted to rack assembly 200 at bottom wall 210 of rack assembly 200. In particular, first spray assembly 222 may be positioned below bottom wall 210 of rack assembly 200, e.g., along the vertical direction V, and direct the first flow of wash fluid towards or into rack assembly 200 through bottom wall 210.

Second spray assembly 224 is positioned and/or oriented for directing a second flow of wash fluid towards or into rack assembly 200. In the exemplary embodiment shown in FIGS. 4 and 5, second spray assembly 224 is shown as a bottle washer assembly 240. However, it should be understood that second spray assembly 224 may be any suitable spray assembly in alternative exemplary embodiments. For example, second spray assembly 224 may be a bowl scrubber, a rotatable spray arm, etc., in alternative exemplary embodiments.

Bottle washer assembly 240 is mounted to rack assembly 200 at bottom wall 210 of rack assembly 200. Bottle washer assembly 240 includes a plurality of spray tines 242. Bottles, such as baby bottles, cups, glasses, etc., may be positioned on and/or over spray tines 242. Spray tines 242 are mounted to a tube 246 of the bottle washer assembly 240 and extend into interior volume 206 of rack assembly 200, e.g., upwardly along the vertical direction V. In particular, spray tines 242 of bottle washer assembly 240 may be distributed between fixed tines 219 of bottom wall 210. For example, each spray tine of spray tines 242 of bottle washer assembly 240 may be positioned between respective pairs of fixed tines 219 as shown in FIGS. 4 and 5.

Spray tines 242 may assist with supporting articles within interior volume 206 of rack assembly 200. In addition, each spray tine of spray tines 242 emits a stream of wash fluid during operation of bottle washer assembly 240. The stream of wash fluid is directed against or onto a bottle or other container positioned over or on each respective one of spray tines 242. In such a manner, bottles and other containers may be more efficiently or completely washed or cleaned during operation of dishwasher appliance 100.

Bottle washer assembly 240 also includes a plurality of clips 244. Each clip of clips 244 is positioned and/or mounted to a respective one of spray tines 242. Clips 244 engage articles, such as bottles, disposed on or over spray tines 242 and hinder or prevent such articles from moving during operation of bottler washer assembly 240. Thus, as an example, when a stream of fluid from one of spray tines 242 impacts a bottle disposed over the one of spray tines 242, an associated one of clips 244 hinders or prevents the bottle from being ejected off the one of spray tines 242 by the stream of fluid.

To provide wash fluid to first spray assembly 222 and second spray assembly 224, rack assembly 200 includes a supply conduit 220. Supply conduit 220 is configured for receiving wash fluid during operation of an associated dishwasher appliance 100 and directing such wash fluid to first spray assembly 222 and/or second spray assembly 224. For example, supply conduit 220 may be in fluid communication with the fluid circulation assembly of dishwasher appliance 100 when rack assembly 200 is in a closed position. Thus, the fluid circulation assembly of dishwasher appliance 100, e.g., variable speed pump 166 of the fluid circulation assembly, may direct wash fluid from tub sump portion 142 of tub 104 to supply conduit 220 during operation of dishwasher appliance 100.

Supply conduit 220 includes a first segment 230 that extends to or towards first spray assembly 222 and a second segment 232 that extends to or towards second spray assembly 224. First segment 230 of supply conduit 220 directs wash fluid therethrough to first spray assembly 222, e.g., during operation of dishwasher appliance 100. Second segment 232 of supply conduit 220 is configured for directing wash fluid to second spray assembly 224, e.g., during operation of dishwasher appliance 100.

Rack assembly 200 also includes features for regulating flows of wash fluid from supply conduit 220 to second spray assembly 224 (e.g., and first spray assembly 222). In particular, rack assembly 200 includes a pressure operated or pressure actuated valve 226 for selectively directing wash fluid from supply conduit 220 to second spray assembly 224, e.g., via second segment 232 of supply conduit 220. Pressure actuated valve 226 is coupled to supply conduit 220, e.g., second segment 232 of supply conduit 220, such that pressure actuated valve 226 selectively permits wash fluid from supply conduit 220 to flow to second spray assembly 224 in a manner similar to pressure actuated valve 170 described above. It should be understood that, in alternative exemplary embodiments, pressure actuated valve 226 may be coupled to supply conduit 220 such that pressure actuated valve 226 selectively permits wash fluid from supply conduit 220 to flow to mid-level spray assembly 148 of dishwasher appliance 100 rather than bottle washer assembly 240.

Pressure actuated valve 226 may also be positioned at any suitable location on rack assembly 200 and/or on dishwasher appliance 100. For example, pressure actuated valve 226 may be positioned on and/or mounted to rack assembly 200. In particular, pressure actuated valve 226 may be positioned at and/or mounted to back wall 216 of rack assembly 200 as shown in FIG. 5. As another example, pressure actuated valve 226 may be positioned within wash chamber 106 of tub 104 and mounted to tub 104. As an additional example, pressure actuated valve 226 may be positioned outside of wash chamber 106 of tub 104 and mounted to tub 104. Rack assembly 200 may also include a cover 228 for protecting pressure actuated valve 226.

Pressure actuated valve 226 can assist with increasing an efficiency of dishwasher appliance 100 and/or improving a consumer satisfaction with dishwasher appliance 100. For example, pressure actuated valve 226 permits a user of dishwasher appliance 100 to deactivate bottle washer assembly 240 when bottle washer assembly 240 is not needed. By only directing wash fluid to bottle washer assembly 240 when needed, a supply of wash fluid to first spray assembly 222 can be increased when bottle washer assembly 240 is not required or in use.

Figure 6:
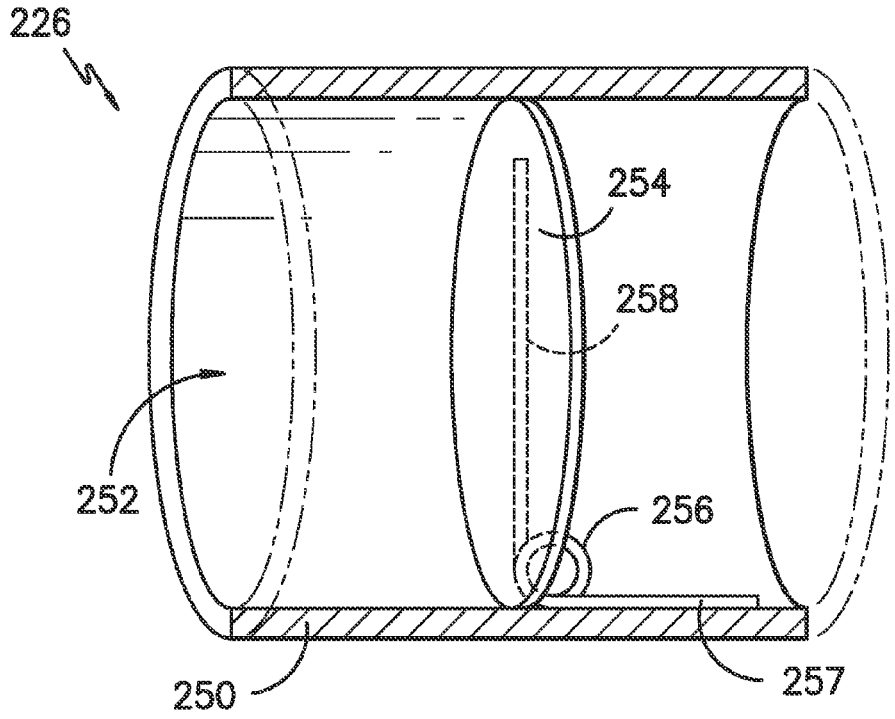
FIG. 6 provides a perspective section view of a pressure actuated valve of the exemplary rack assembly of FIG. 3 with the pressure actuated valve shown in a closed configuration.
Figure 7:
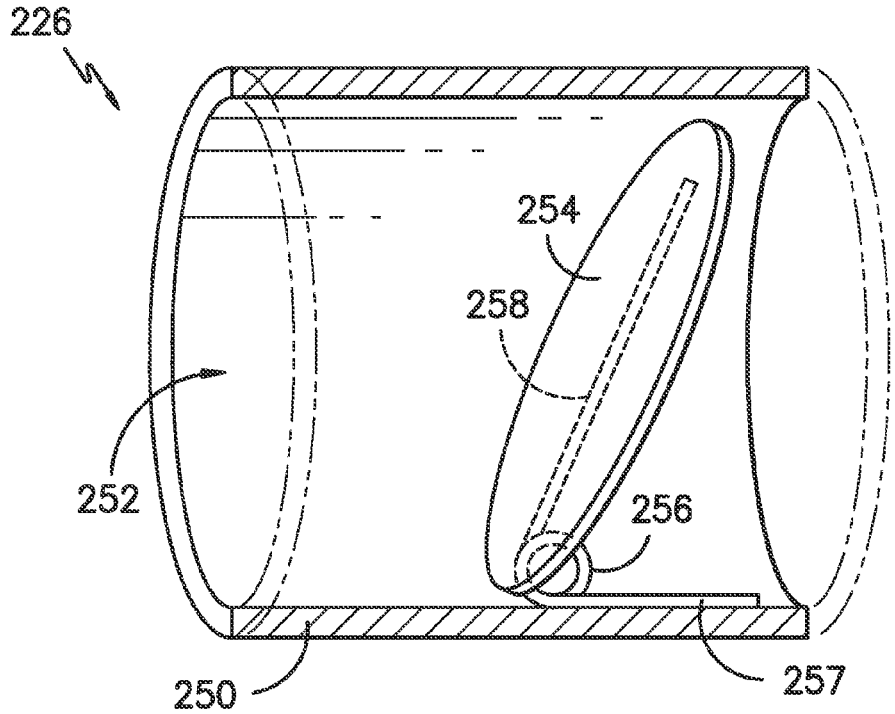
FIG. 7 provides a perspective section view of the pressure actuated valve of the exemplary rack assembly of FIG. 3 with the pressure actuated valve shown in an open configuration.

FIGS. 6 and 7 provide perspective section views of pressure actuated valve 226. In FIG. 6, pressure actuated valve 226 is shown in a closed configuration. In FIG. 7, pressure actuated valve 226 is shown in an open configuration. It should be understood that pressure actuated valve 226 provided in FIGS. 6 and 7 is provided by way of example only and that any other suitable pressure actuated valve may be used in rack assembly 200 (FIG. 4) in alternative exemplary embodiments. Pressure actuated valve 226 may also be used in dishwasher appliance 100 (FIG. 2), e.g., as pressure actuated valve 170.

As may be seen in FIGS. 6 and 7, pressure actuated valve 226 includes a body 250. Body 250 may be mounted to supply conduit 220. In particular, body 250 defines a passage 252 that may be positioned for receiving fluid from second segment 232 of supply conduit 220. Pressure actuated valve 226 also includes a orifice plate or valve seat 254 and a biasing mechanism 256. Valve seat 254 is disposed within passage 252 of body 250 and is selectively adjustable between a closed position (FIG. 5) in which valve seat 254 blocks or hinders fluid flow through passage 252 and an open position (FIG. 6) in which valve seat 254 does not substantially block or hinder fluid flow through passage 252.

Biasing mechanism 256 urges valve seat 254 towards the closed position. Biasing mechanism 256 may be any suitable mechanism for urging valve seat 254 towards the closed position. For example, biasing mechanism 256 may be a torsion spring with a first leg 257 mounted to body 250 and a second leg 258 mounted to valve seat 254. As the pressure of wash fluid within passage 252 increases, a force applied to valve seat 254 by the wash fluid increases. In particular, when the pressure of wash fluid within passage 252 exceeds a threshold pressure, the force applied to valve seat 254 by the wash fluid exceeds the force applied to valve seat 254 by biasing mechanism 256 and valve seat 254 moves or adjusts to the open position. In such a manner, valve seat 254 may adjust between the open and closed positions.

Figure 8:
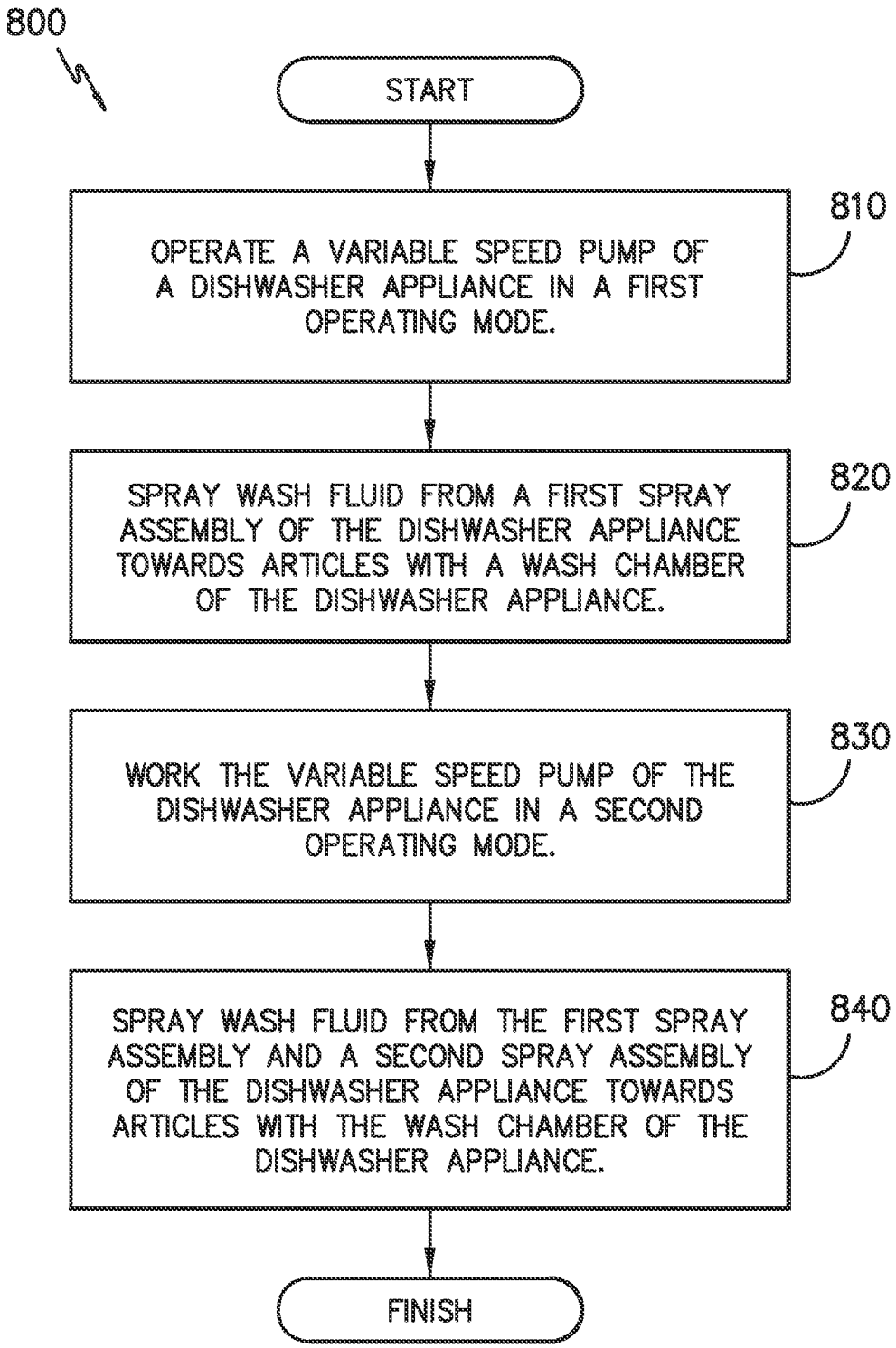
FIG. 8 illustrates a method for operating a dishwasher appliance according to an exemplary embodiment of the present subject matter.

FIG. 8 illustrates a method 800 for operating a dishwasher appliance according to an exemplary embodiment of the present subject matter. Method 800 may be used to operate any suitable dishwasher appliance. For example, method 800 may be used to operate dishwasher appliance 100 (FIG. 2). Controller 116 of dishwasher appliance 100 may be programmed or configured to implement method 800. Utilizing method 800, at least one spray assembly of an associated dishwasher appliance may be selectively activated and deactivated with a pressure actuated valve.

At step 810, controller 116 operates variable speed pump 166 in the first operating mode. Variable speed pump 166 supplies wash fluid to supply conduit 164 at the first pressure during step 810 when motor 167 is in the first operating mode. Thus, pressure actuated valve 170 is in the closed configuration during step 810. At step 820, wash fluid from first spray assembly 160 is sprayed towards articles within wash chamber 106 of tub 104, e.g., during step 810. In addition, second spray assembly 162 does not spray wash fluid towards the articles within wash chamber 106 of tub 104 during said step 820 due to pressure actuated valve 170 being in the closed configuration and blocking wash fluid from flowing to second spray assembly 162.

At step 830, controller 116 operates variable speed pump 166 in the second operating mode. Variable speed pump 166 supplies wash fluid to supply conduit 164 at the second pressure during step 830 when motor 167 is in the second operating mode. The second pressure at step 830 may be greater than the first pressure at step 810. Thus, pressure actuated valve 170 is in the open configuration during step 830. At step 840, wash fluid from first spray assembly 160 is sprayed towards articles within wash chamber 106 of tub 104, e.g., during step 830. In addition, second spray assembly 162 sprays wash fluid towards the articles within wash chamber 106 of tub 104 during said step 840 due to pressure actuated valve 170 being in the open configuration and not blocking or hindering wash fluid from flowing to second spray assembly 162.

Utilizing method 800, the pressure of wash fluid within supply conduit 164 may be adjusted in order to selectively open and close pressure actuated valve 170. In turn, operation of second spray assembly 162 may be controlled such that second spray assembly 162 may be activated and deactivated by adjusting the pressure of wash fluid within supply conduit 164. Thus, method 800 may assist a user of dishwasher appliance 100 with avoiding unnecessary operation of second spray assembly 162, e.g., by adjusting the operating conditions of variable speed pump 166.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a tub defining a wash chamber;

a rack assembly disposed within the wash chamber of the tub;

a first spray assembly positioned adjacent the rack assembly such that the first spray assembly is positioned for directing a first flow of wash fluid towards the rack assembly;

a second spray assembly positioned adjacent the rack assembly such that the second spray assembly is positioned for directing a second flow of wash fluid towards the rack assembly;

a supply conduit;

a pressure actuated valve coupled to the supply conduit such that the pressure actuated valve selectively permits wash fluid from the supply conduit to flow to the second spray assembly when a pressure of wash fluid within the supply conduit exceeds a threshold pressure; and wherein wash fluid from the supply conduit flows to the first spray assembly when the pressure of wash fluid within the supply conduit is less than the threshold pressure and wherein increasing the pressure of wash fluid within the supply conduit such that the pressure exceeds the threshold pressure opens the pressure actuated valve such that wash fluid from the supply conduit flows to both the first spray assembly and the second spray assembly.

2. The dishwasher appliance of claim 1, wherein the first spray assembly comprises a spray arm rotatably mounted to the rack assembly at a bottom wall of the rack assembly and the second spray assembly comprises a bottle washer assembly mounted to the rack assembly at the bottom wall of the rack assembly, the bottle washer assembly comprising a plurality of spray tines that extend away from the bottom wall of the rack assembly.

3. The dishwasher appliance of claim 1, wherein the pressure actuated valve is positioned on the rack assembly.

4. The dishwasher appliance of claim 1, wherein the pressure actuated valve is positioned within the wash chamber of the tub.

5. A dishwasher appliance defining a vertical direction, the dishwasher appliance comprising:

a tub defining a wash chamber, the wash chamber extending between a top portion and a bottom portion along the vertical direction;

a lower rack assembly disposed within the wash chamber of the tub and positioned adjacent the bottom portion of the wash chamber;

an upper rack assembly disposed within the wash chamber of the tub and positioned above the lower rack assembly along the vertical direction;

a first spray assembly positioned adjacent the lower rack assembly such that the first spray assembly is positioned for directing a first flow of wash fluid towards the lower rack assembly;

a second spray assembly positioned adjacent the upper rack assembly such that the second spray assembly is positioned for directing a second flow of wash fluid towards the upper rack assembly;

a variable speed pump comprising a motor and an impeller, the impeller coupled to the motor such that the motor selectively rotates the impeller;

a supply conduit extending from the variable speed pump to the first and second spray assemblies, the supply conduit configured for directing wash fluid from the variable speed pump to the first and second spray assemblies;

a pressure actuated valve coupled to the supply conduit such that the pressure actuated valve permits wash fluid from the supply conduit to flow to the second spray assembly when the pressure actuated valve is in an open position; and a controller in operative communication with the variable speed pump, the controller configured for selectively adjusting the pressure actuated valve between the open position and a closed position by adjusting a pressure of wash fluid within the supply conduit, adjusting the pressure of wash fluid within the supply conduit comprising operating the motor of the variable speed pump in either of a first operating mode comprising a first pressure less than a threshold pressure of the pressure actuated valve or a second operating mode comprising a second pressure greater than the threshold pressure of the pressure actuated valve;

wherein the pressure actuated valve is in the closed position such that wash fluid from the supply conduit flows to the first spray assembly and is blocked from flowing to the second spray assembly by the pressure actuated valve when the motor is operating in the first operating mode and the pressure actuated valve is in the open position such that wash fluid from the supply conduit flows to both the first and second spray assemblies when the motor is operating in the second operating mode.

6. The dishwasher appliance of claim 5, wherein the motor rotates the impeller at a first average speed in the first operating mode, and the motor rotates the impeller at a second average speed in the second operating mode, the first and second average speeds being different.

7. The dishwasher appliance of claim 5, wherein a portion of the supply conduit is mounted to a back wall of the tub.

8. The dishwasher appliance of claim 5, wherein the pressure actuated valve is positioned adjacent a sump of the tub at a bottom portion of the wash chamber.

9. The dishwasher appliance of claim 5, wherein the variable speed pump is positioned adjacent the sump of the tub.

10. The dishwasher appliance of claim 5, wherein the pressure actuated valve is positioned within the wash chamber of the tub.

11. The dishwasher appliance of claim 5, wherein the first spray assembly comprises a lower spray arm positioned below the lower rack assembly and the second spray assembly comprises an upper spray arm positioned below the upper rack assembly.

12. A method for operating a dishwasher appliance, comprising:

operating a variable speed pump of the dishwasher appliance in a first operating mode, the variable speed pump supplying wash fluid to a supply conduit of the dishwasher appliance at a first pressure and a pressure actuated valve of the dishwasher appliance being in a closed configuration during said step of operating, the first pressure being less than a threshold pressure;

spraying wash fluid from a first spray assembly of the dishwasher appliance towards articles within a wash chamber of the dishwasher appliance during said step of operating, a second spray assembly of the dishwasher appliance not spraying wash fluid towards the articles within the wash chamber during said step of spraying;

adjusting the pressure of wash fluid within supply conduit to open the pressure actuated valve by working the variable speed pump of the dishwasher appliance in a second operating mode, the variable speed pump supplying wash fluid to the supply conduit of the dishwasher appliance at a second pressure greater than the threshold pressure in the second operating mode; and directing wash fluid from the first and second spray assemblies of the dishwater appliance towards articles within the wash chamber of the dishwasher appliance during said step of adjusting.

13. The method of claim 12, wherein the supply conduit extends between the variable speed pump and the first and second spray assemblies, the pressure actuated valve coupled to the supply conduit.

14. The method of claim 13, wherein the pressure actuated valve is positioned at a sump of the dishwasher appliance.

15. The method of claim 13, wherein the pressure actuated valve is positioned within the wash chamber of the dishwasher appliance.

16. The method of claim 12, wherein the variable speed pump comprises a motor and an impeller, the impeller coupled to the motor such that the motor selectively rotates the impeller, the motor rotating the impeller at a first average speed during said step of operating, the motor rotating the impeller at a second average speed during said step of working, the second average speed being greater than the first average speed.

* * * * *